US006047709A

United States Patent [19]

Tu

[11] Patent Number: 6,047,709

[45] Date of Patent: Apr. 11, 2000

[54] REPLACEABLE HAIR DECORATIVE MEMBERS

[76] Inventor: Yuan Ming Tu, No. 9, Alley 27, Lane 407, Sec. 1, Chang Hsi Street, Tainan City, Taiwan

[21] Appl. No.: 09/305,649

[22] Filed: May 5, 1999

[51] Int. Cl.[7] ..... A45D 8/12

[52] U.S. Cl. ..... 132/275; 132/273; 2/171; 2/DIG. 11; 446/27; 40/329

[58] Field of Search ..... 132/273, 275, 132/276, 279, 277, 278, 144; 2/171, 171.01, DIG. 11, 209.13, 244; 446/26, 27, 486; 40/315, 329, 409; D28/41, 39, 40

[56] References Cited

U.S. PATENT DOCUMENTS

| | | | |
|---|---|---|---|
| D. 287,891 | 1/1987 | Cavaliere | D28/41 |
| 1,715,331 | 5/1929 | Richter | 132/275 |
| 2,611,902 | 9/1952 | Rockmore | 2/171 |
| 3,098,316 | 7/1963 | McCarthy | 132/275 |
| 4,936,699 | 6/1990 | Yoshida | 446/26 |
| 5,027,992 | 7/1991 | Murray, III | 2/DIG. 11 |
| 5,530,970 | 7/1996 | Knutson | 2/209.13 |

*Primary Examiner*—Gene Mancene
*Assistant Examiner*—Pedro Philogene
*Attorney, Agent, or Firm*—Rosenberg, Klein & Lee

[57] ABSTRACT

A hair holding includes a main body with an outer periphery. A number of first pegs are formed on the outer periphery of the main body. A spring is removably attached to each first peg, and a decorative member with a second peg is removably attached to each spring. Each spring has a first end with a first hole slightly greater than an associated first peg. Each spring has a second end with a second hole slightly greater than the peg of an associated decorative member. The user may change the decorative members whenever she likes, thereby obtaining numerous combinations of the decorative members.

2 Claims, 5 Drawing Sheets

REPLACEABLE HAIR DECORATIVE MEMBERS

BACKGROUND OF THE INVENTION

1. Field of the Invention

The present invention relates to replaceable hair decorative members for a hair holder of the type having an arcuate configuration.

2. Description of the Related Art

Most women use a hair holder to hold her hair and to provide an aesthetically pleasing effect. FIG. 5 of the drawings illustrates a typical hair holder of the type having an arcuate configuration. The hair holder includes an arcuate main body 1' with inner and outer peripheries thereof treated by e.g., baking varnish, spraying painting, or deposition to form decorative patterns 11' for decorative purpose. Nevertheless, the patterns 11' are fixed such that the user must buy a lot of hair holders with different patterns to fit different needs. The present invention is intended to provide a hair holder with replaceable decorative members to solve this problem.

SUMMARY OF THE INVENTION

A hair holder in accordance with the present invention comprises a main body with an outer periphery. At least one first peg is formed on the outer periphery of the main body. At least one spring has a first end removably attached to said at least one first peg and a second end. At least one decorative member has a second peg extended therefrom and removably attached to the second end of said at least one spring.

Each end of said at least one spring includes a hole slightly greater than the associated peg.

In a preferred embodiment of the invention, a hair holding comprises a main body with an outer periphery. A plurality of first pegs are formed on the outer periphery of the main body. A spring is removably attached to each first peg, and a decorative member with a second peg is releasably attached to each spring. Each spring has a first end with a first hole slightly greater than an associated first peg. Each spring has a second end with a second hole slightly greater than the peg of an associated decorative member.

The user may change the decorative members whenever she likes, thereby obtaining numerous combinations of the decorative members.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
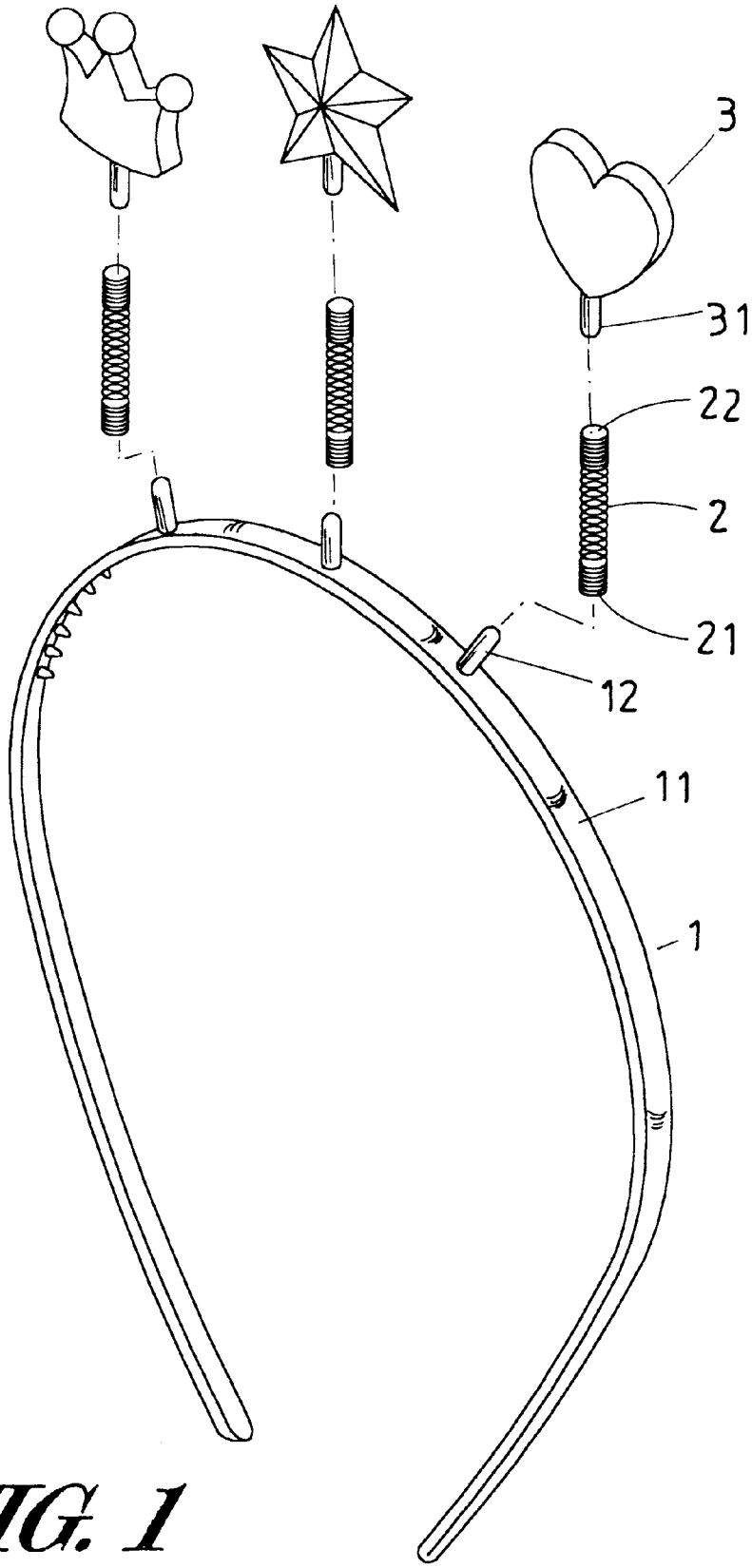
FIG. 1 is an exploded perspective view of a hair holder with replaceable decorative members in accordance with the present invention.
Figure 2:
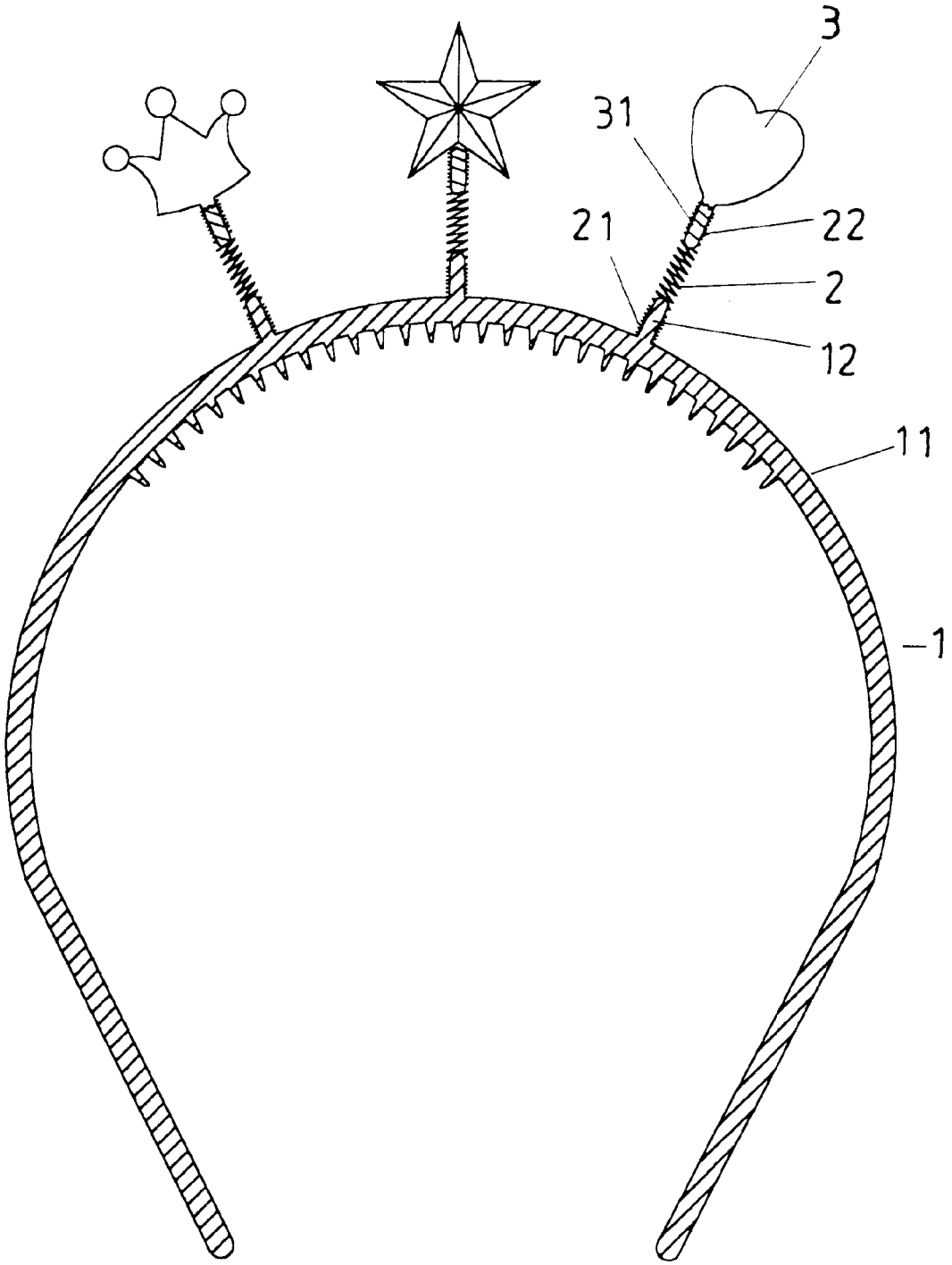
FIG. 2 is a sectional view of the hair holder in accordance with the present invention.
Figure 3:
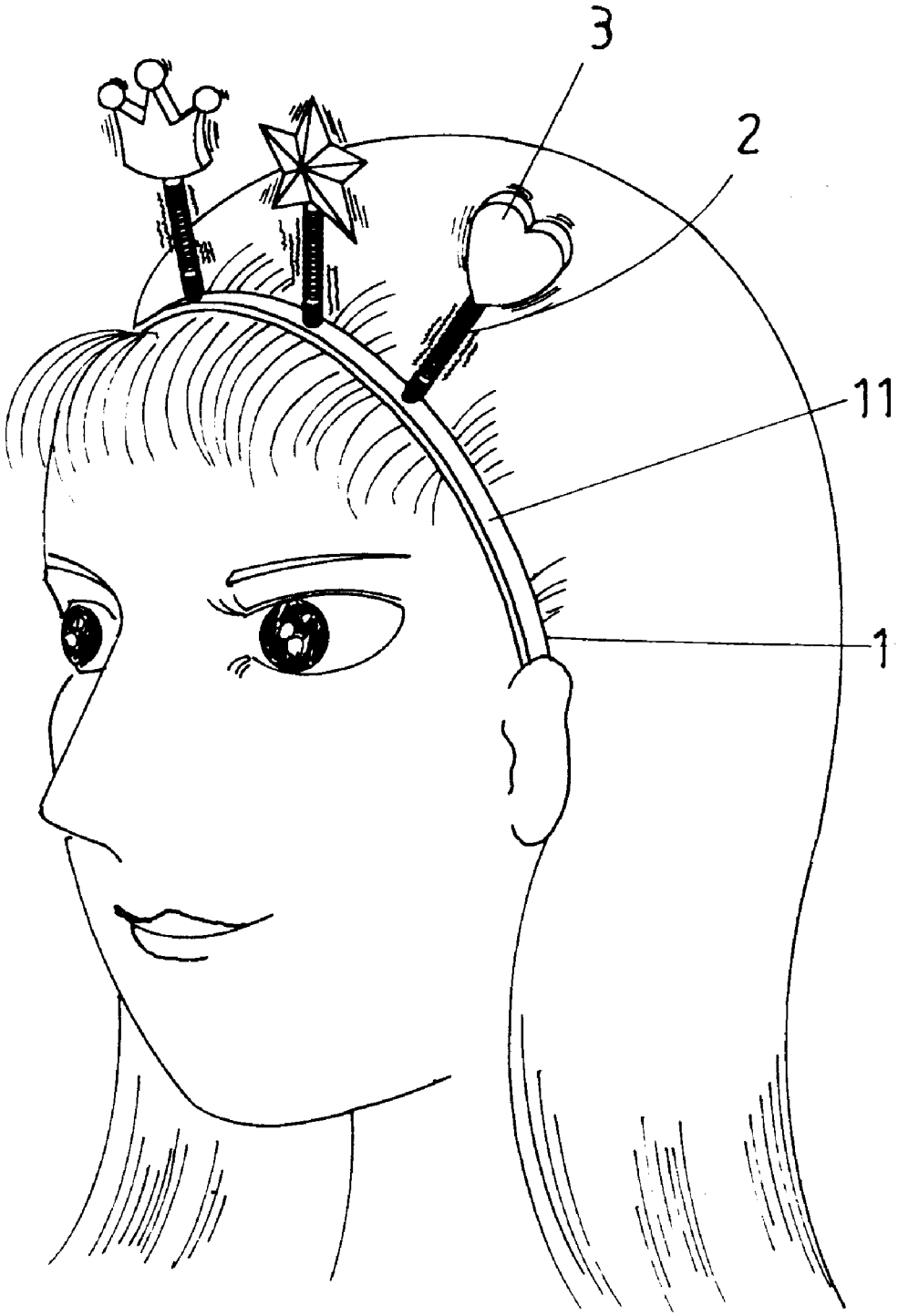
FIG. 3 is a schematic view illustrating use of the hair holder in accordance with the present invention.

Referring to FIGS. 1 and 2, a hair holder in accordance with the present invention generally includes an arcuate main body 1 having at least one peg 12 (three pegs 12 in this embodiment) on an outer periphery thereof. A spring 2 is removably attached to each peg 12. Each spring 2 includes a first end with a hole 21 for receiving the peg 12 and a second end with a hole 22 for receiving a peg 31 extended from a decorative member 3. The hole 21, 22 is sized to be slightly greater than that of the peg 12, 31. The spring 12 is of an appropriate length so as to be flexible to provide an aesthetically pleasing effect when the user's head moves, best shown in FIG. 3. The spring 2 supports the associated decorative member 3.

Figure 4:
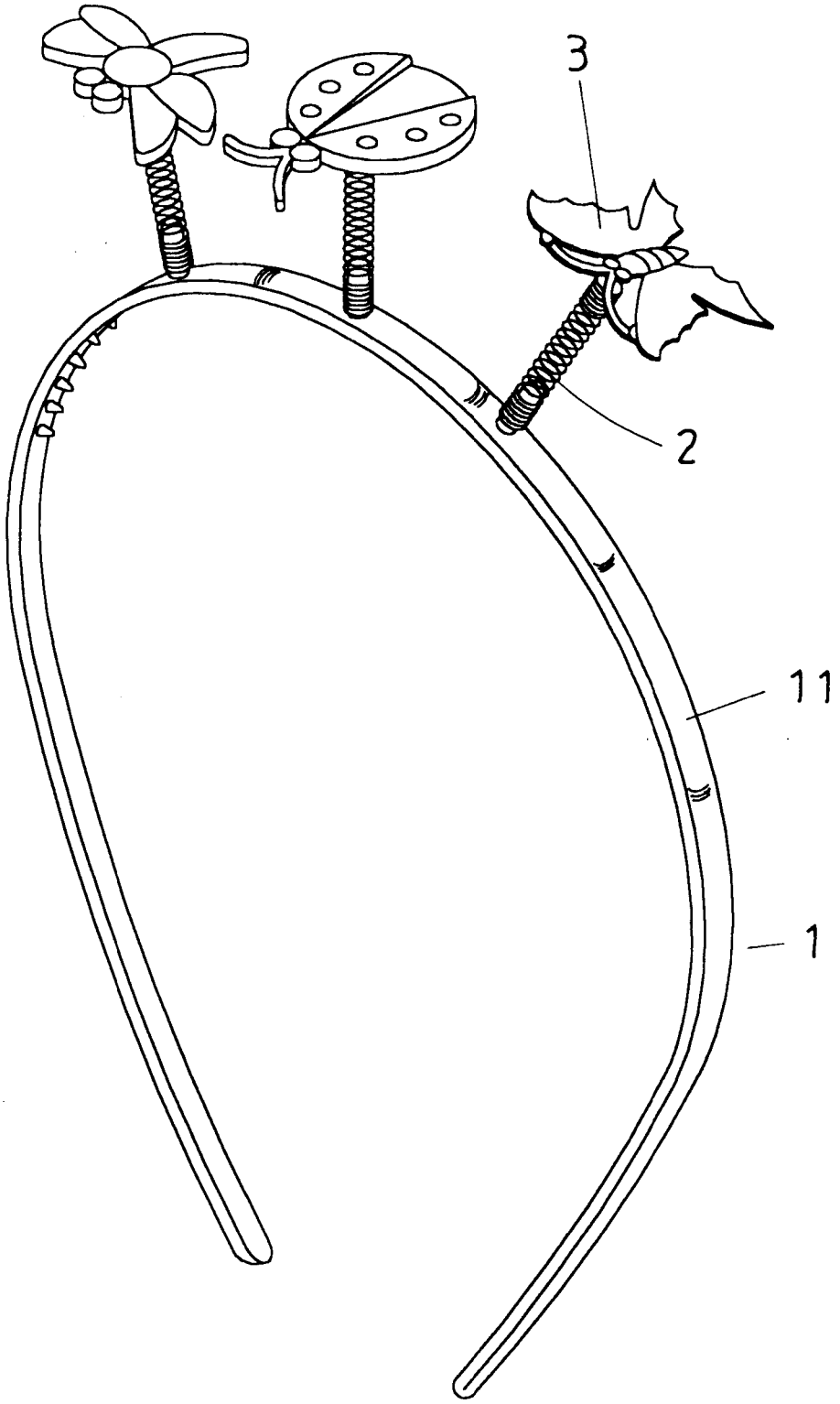
FIG. 4 is a perspective view of a hair holder with different patterned decorative members in accordance with the present invention.
Figure 5:
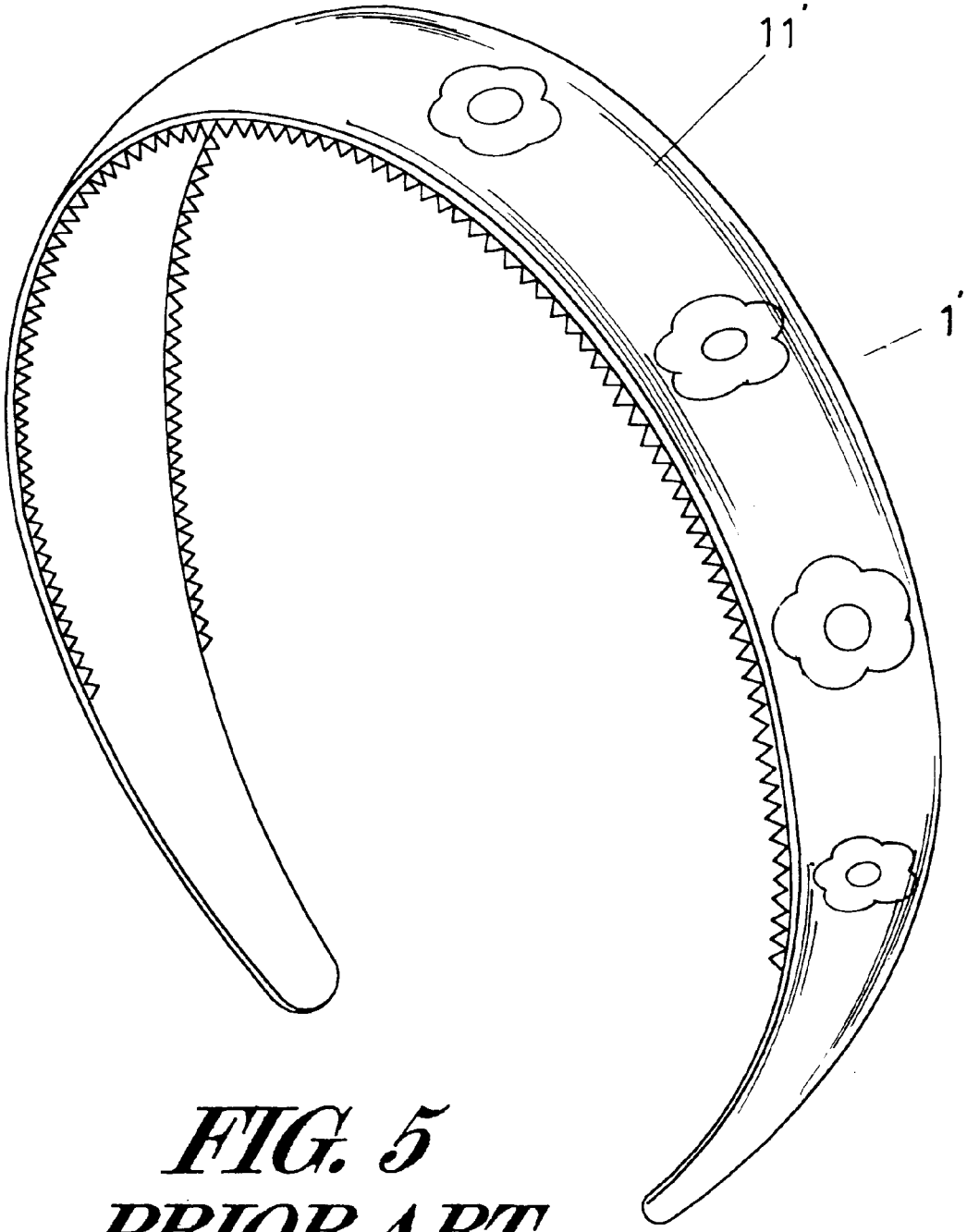
FIG. 5 PRIOR ART
FIG. 5 is a perspective view of a conventional hair holder.

FIG. 4 illustrates decorative members of different patterns. It is appreciated that the user may change the decorative members 3 whenever she likes. Thus, numerous combinations of the decorative members can be obtained. The decorative members can be removed from the main body 1 and thus provides a conventional hair holder.

Although the invention has been explained in relation to its preferred embodiment, it is to be understood that many other possible modifications and variations can be made without departing from the spirit and scope of the invention as hereinafter claimed.

What is claimed is:

1. A hair holder comprising a main body with an outer periphery, at least one first peg extending from the outer periphery of the main body and having a first diameter dimension, at least one spring having a substantially cylindrical contour, said spring having openings of a second diameter dimension formed in opposing first and second ends of said spring, said second diameter dimension being slightly greater than said first diameter dimension, said opening in said first end of said spring receiving said at least one first peg therein and being supported thereby, and at least one decorative member having a second peg extending therefrom, said second peg having said first diameter dimension and being received in said opening in said second end of said at least one spring.

2. A hair holder comprising a main body with an outer periphery, a plurality of first pegs being formed on the outer periphery of the main body, a plurality of springs respectively removably attached to each said first peg, and a plurality of decorative members, each of said decorative members being formed with a second peg for removable attachment to a respective spring, each said spring having a substantially cylindrical contour and a first end with a first hole having a diameter slightly greater than a diameter of an associated one of said first pegs for receiving said peg therein to support said spring on said main body, each said spring having a second end with a second hole having a diameter slightly greater than a diameter of the second peg of an associated one of said decorative members.

* * * * *